United States Patent [19]

Gau

[11] Patent Number: 4,531,995

[45] Date of Patent: Jul. 30, 1985

[54] LABELING MACHINE FOR CONTAINERS

[75] Inventor: George Gau, Obertraubling, Fed. Rep. of Germany

[73] Assignee: Krones AG Hermann Kronseder Maschinenfabrik, Neutraubling, Fed. Rep. of Germany

[21] Appl. No.: 584,727

[22] Filed: Feb. 29, 1984

[30] Foreign Application Priority Data

Mar. 4, 1983 [DE] Fed. Rep. of Germany ..... 3307662

[51] Int. Cl.[3] ..... B65C 9/04

[52] U.S. Cl. ..... 156/456; 156/458; 156/564; 156/567; 156/DIG. 26; 156/DIG. 29

[58] Field of Search ..... 156/447, 448, 456, 458, 156/564, 567, DIG. 26, DIG. 29

[56] References Cited

U.S. PATENT DOCUMENTS

| | | | |
|---|---|---|---|
| 4,092,207 | 5/1978 | Zodrow | 156/568 |
| 4,430,141 | 2/1984 | Zodrow | 156/458 |
| 4,487,650 | 12/1984 | Mohn et al. | 156/456 |

*Primary Examiner*—Michael Wityshyn

*Attorney, Agent, or Firm*—Fuller, House & Hohenfeldt

[57] ABSTRACT

A labeling machine has a rotationally driven wheel on which there are can supporting disks supported for rotation on respective shafts. Each shaft has a gear composed of a circular member having angularly spaced apart rollers that engage in the teeth of stationary cam rings. Consecutive sections of the teeth have increasingly large pitches in the direction of wheel rotation so that by engagement of the rollers in the teeth the rotational velocity of the cans supported on the shafts increases. The label holder is mounted on an arm and is concentric with the axis of the wheel. By unclamping the arm and rotating it to proximity with one of the toothed cam sections, the can will be rotating with a particular peripheral velocity that results in a can of the proper diameter to roll onto a label without any skidding or slipping action such that the label will always be picked up at its leading edge by means of a glue strip which has been previously applied to the can.

7 Claims, 4 Drawing Figures

E
12
13
10
11
51
6
7
2
52
9
14
5
50
15
16
4
1
3
e6
e5
e4
e3
e2
e1
E
24
23

Fig. 2
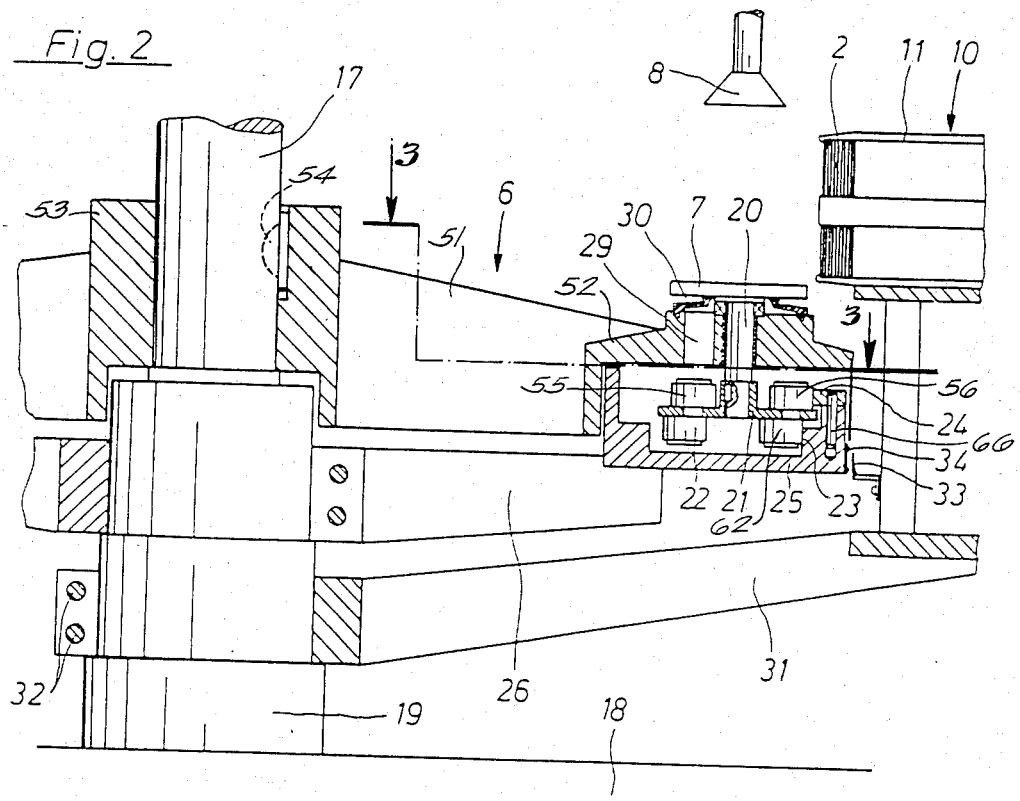
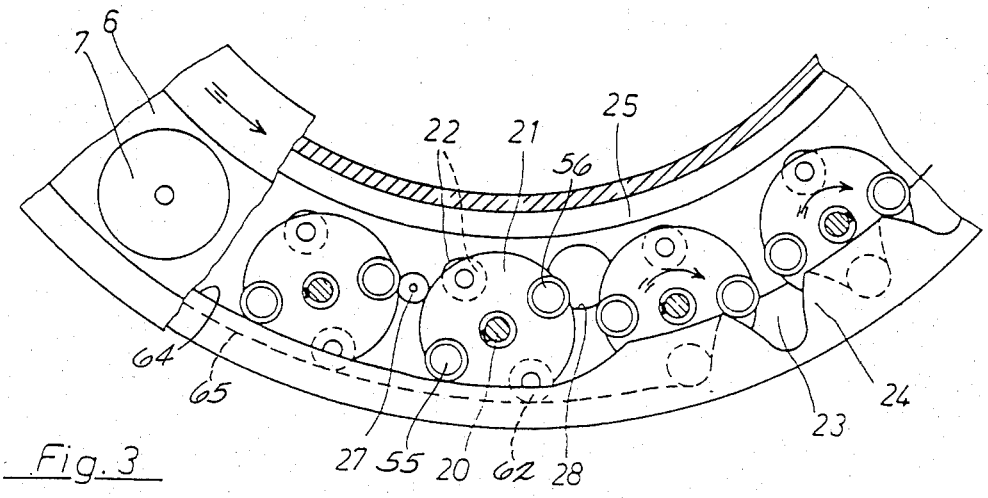
Fig. 3

LABELING MACHINE FOR CONTAINERS

BACKGROUND OF THE INVENTION

This invention relates to a machine for applying labels to containers such as cylindrical cans having various diameters.

In one known type of labeling machine a wheel rotates about a vertical axis. Several shafts are equiangularly spaced about the wheel on a common circle. The shaft axes are parallel to the rotational axis of the wheel. There is a circular plate on the top of each shaft for supporting a container, such as a can that is to be labeled. Several gears are fastened on each shaft. A toothed belt is selectively brought into engagement with gears of the same size on each shaft for the purpose of changing the rotational speed of the shafts to facilitate applying labels to containers having different diameters. This is necessary because each container is orbited past a station wherein a longitudinal strip of glue is applied to it after which the container is carried past a stack of labels. The rotating container is rolled onto the surface of an exposed label which is picked up by adhesion to the glue stripe and carried forward to a station where the label is wrapped around the container. The toothed belt and gear arrangement for adjusting the rotational rates of the disks and the containers requires a construction wherein moving parts are out in the open to make it easy for servicing personnel to grasp and reverse or tilt the toothed belt. Thus, protection against environmental influences is hardly afforded. Moreover, reversal or tilting of the toothed belt is time consuming and inconvenient.

In another known type of labeling machine the rotating disks for the shafts therefor are connected with a planetary wheel which engages in a sun-wheel arranged concentrically to the rotary disks. The sun-wheel is supported rotatably and driven by means of a back-gearing arrangement with an adjustable rotating shaft and an exchangeable change-gear synchronously with the rotary disks. Different rates of rotation of the rotary disks are obtained by exchanging gears. One disadvantage of this arrangement is that an individual change-gear must be manufactured and held in stock for the various container diameters that the labeling must be able to handle. Besides changing gears, the rotating shafts must be adjusted in insure proper change-gear meshing with the sun-wheel. This is time consuming and requires substantial skill. It is not possible to securely enclose the gearing since engagement between the sun-wheel and change-gear must be observed.

In another known labeling machine there is a stationary lifting cam for the rotary plates. The rise and fall of the cam is converted into rotation of the plates through a coarse-thread-gearing. Planetary gearing sets the rotary plates into oscillating or rotational movement. The cam is comprised of several curved pieces which are individually exchangeable. Disadvantageously, a series of individual curved pieces must be made and held in stock for each container diameter that the labeling machine must accommodate.

SUMMARY OF THE INVENTION

The primary object of the present invention is to provide a labeling machine for containers that can be adjusted rapidly and easily for changing the rotational speed of the container supporting plates and, hence, facilitating handling containers of a wide variety of diameters.

A more specific object is to eliminate the need for exchanging gears or doing anything else on the rotating wheel to which the rotatable container supporting plates are mounted. This object is achieved by an arrangement which simply requires shifting the label pickup station to various positions along the circular path of the containers to provide for accommodating containers having different diameters by imparting to the containers a particular rotational speed.

According to the invention, all required speeds of rotation for the rotary plates are fully integrated in the gearing and are all later continuously carried out by the rotary plates so that when containers or cans of different diameters are handled by the machine anything fastened on the plate shafts is completely unaffected. Consequently, the construction can be simple and fully enclosed to avoid adverse environmental effects.

How the foregoing and other more specific objects of the invention are achieved will be evident in the more detailed description of a preferred embodiment of the invention which will now be set forth in reference to the drawings.

DESCRIPTION OF THE DRAWINGS

FIG. 2 is a vertical section taken on the line corresponding to 2—2 in FIG. 1;

FIG. 3 is a transverse section taken on the irregular line 3—3 in FIG. 2.

DESCRIPTION OF THE PREFERRED EMBODIMENT

Figures 1, 4:
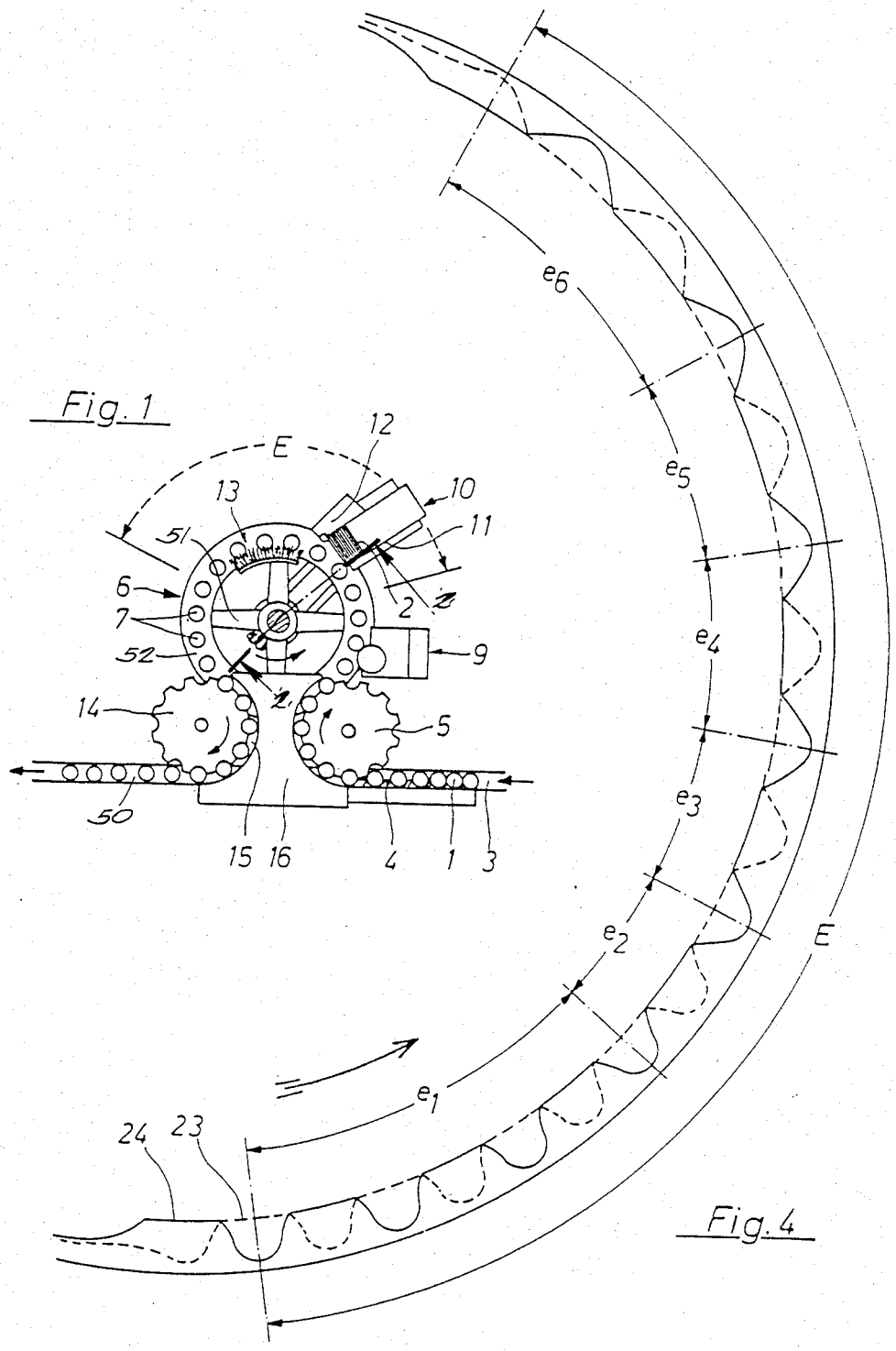
FIG. 1 is a diagrammatic plan view of a labeling machine wherein the machine housing and the parts that engage the containers from the top to keep them centered on the rotating disks are omitted.
FIG. 4 is a fragmentary plan view of two similar toothed cams that are arranged congruently to each other and extend circumferentially over the angle labeled E in FIG. 1.

The labeling machine shown in the drawings is designed for applying and wrapping around labels on cylindrical cans. As shown in FIG. 1, the cans are supplied to the machine by means of a conveyor belt 3 and are advanced into the machine by an inlet worm 4. The inlet worm advances the cans into the peripheral recesses of a starwheel 5 which is driven in the direction of the arrow indicated thereon. The starwheel advances the cans and deposits them on consecutive can supporting plates 7 which are moved in a circle by reason of them being supported on a rotating wheel or table 6 that rotates in the direction of the arrow thereon.

As can be seen in FIG. 2, a can supported on plate 7 can be engaged on its top by means of a centering bell 8 which is lowered in synchronism with the can being deposited on a rotating plate 7 so as to stabilize the can until it is labeled and discharged by way of the output starwheel 14 depicted in FIG. 1.

The cans 1 on the rotary wheel-like table 6 first pass by a glue application station 9 where a vertical stripe of glue is applied to them. Subsequently, as a can is rotating about its vertical axis, it reaches a labeling station 10 comprised of a stationary label storage device or container 11. The can is rolled on the surface of the exposed label in the container so that a label will be picked up by the adhesive stripe. The rotating can next encounters a known device 12 which overlaps the label ends to effect adhesion. Next the cans 1, which are rotating at this time, pass through a brush-on station 13 where the wrapped labels are pressed tightly onto the cans and smoothed. After this operation, the centering bell 8 is retracted and the cans are fed to the output starwheel 14 and deposited on a conveyor 50. In the area of the inlet starwheel 5 and the outlet starwheel 14 the cans stand on slide-rails 15 and are guided and stabilized by a guide member 16.

Rotary table 6 is basically a wheel having spokes 51 and a rim 52 which is generally U-shaped in cross-section and has a downwardly open bottom. The hub 53 of the wheel is fastened to a vertical shaft 17 by means of a key 54. The drive mechanism for shaft 17 is not shown but is in a mechanism housing symbolized by the region marked 18. Shaft 17 is rotatable in a stationary sleeve 19 which is fixed to housing 18. Shaft 17 can be driven at various rotational speeds which are always synchronized with the speed of the can inlet worm 4 and the inlet and outlet starwheels 5 and 14, respectively.

In the rim 52 of wheel 6 there are several vertical shafts 20 distributed uniformly or equiangularly over the circumference of the rim and journaled for rotation in rim 52. The circular can supporting plates 7 are mounted to the upper ends of vertical shafts 20. There is a circular member or disk 21 fastened to the lower end of each shaft 20. This disk supports two pairs of follower rollers, one pair comprised of rollers 55 and 56 mounted to the top of disk 21 for rotation about axes parallel to the shafts 20 on some stub shafts that are fixed in the disk. Top rollers 55 and 56 are diametrically opposite of each other and equally radially spaced from the axis of shaft 20. The other pair of rollers 22 and 62 are mounted to the bottom of disk 21 and are rotatable on stub shafts that are fixed in member 21. Diametrically opposite lower rollers 22 and 62 are displaced by 90° from the upper pair of rollers 55 and 56. In a sense, the four rollers are comparable to cogs or teeth of a first gear means which are engageable in the teeth of second gear means on lower and upper stationary cam rings 23 and 24 as will be further explained.

In FIGS. 3 and 4, the upper cam ring 24 is shown in solid lines and the lower cam ring 23 is shown in dashed lines. As the rim 52 of table 6 rotates, upper rollers 55 and 56 engage in the teeth of upper cam ring 24 and the lower rollers 22 and 62 engage in the teeth of lower cam ring 23 and, in so doing, impart rotational motion to the shafts 20 and their container supporting plates 7. The teeth in the upper and lower rings are shifted rotationally by the distance of one tooth pitch. As shown in FIG. 2, the cam ring 23 is formed in an upwardly opened U-shaped part 25 of wheel arm 26 and the upper cam ring 24 is separate and anchored to the U-shaped member 25 with pins such as the one marked 66. As shown in FIGS. 3 and 4, the teeth of cams 23 and 24 do not extend over the entire circular path of the wheel rim but only through a limited angle marked E in FIGS. 1 and 4. The remainder of the cams have untoothed surfaces 64 and 65 which are concentric to the rotational axis of wheel or rotary table 6 so that no rotational motion is imparted to the can supporting plates 7 as the rollers simply make tangential contact with the continuously curved untoothed portions of the cam 65. As is evident in FIG. 4, the pitch of the rotationally displaced similar teeth on cams 23 and 24 increases in the direction of rotation of table or wheel 6. As shown, there are several different pitch changes $e_1$ and $e_6$. It will be evident that as the rollers 55, 56, 22 and 62 progress along these teeth, different rates of rotation will be imparted to the can supporting plates 7. A relative standstill of the rotary disks 7 is advantageous, for example, in the area of the inlet starwheel 5, at the outlet starwheel 14 and the glue stripe application station 9. Rotation of the rotary plates 7 is necessary in the region of the labeling station 10 and the brush-on station 13. In this embodiment, the two cams 23 and 24 are formed in such manner that, in conjunction with the relative standstill of the rotary disks 7 in the region of the inlet starwheel 5 and the glue application station 9, they drive the rotary disks in the labeling area E one after the other with different rotary or angular speeds. It is to be recognized that the rotary plates 7 are driven first in the tooth section $e_1$ with a certain angular velocity depending on the tooth pitch in that section. The angular velocity is determined in such manner that, on the rotary plates 7 on which the cans are held by rotatable centering bells 8, cans with a specific diameter may make tangential contact with the leading ends of a label and roll along the label without skidding on it. In other words, the absolute velocity in the periphery of the circular path is equal to 0. In the following circular regions $e_2$ to $e_6$ the can supporting rotary plates 7 are driven at a progressively lower angular velocity than in the previous region for the purpose of adapting to correspondingly larger can diameters. The first region $e_1$ and the last region $e_6$ are somewhat longer than the other regions $e_2$ to $e_5$ in order to insure full acceleration of the cans 1 through the velocity of $e_1$ on the one hand and rotation of the cans in the brush-on station 13 on the other hand. Otherwise, the toothed regions which provide a determined angular speed for the disks may be selected relatively short since an exact adaptation of the angular speed to the can diameter is required only during the rolling action of the cans on the label or when the can is encountering the glued circumferential area on the front edge of the wrapped labels 2 in the label containing device 11. Advantageously, the angular velocity of the cans declines as the labels encounter the label pressing device 12. In the actual embodiment, between the regions $e_1$ to $e_6$ which provide constant predetermined angular velocities, there are still formed delaying regions in the cams 23 and 24 which, on account of their shortness, are not shown separately. Backward braking of the rotary disks is thereby prevented. Thus, in the present design, six different speeds of can rotation for six different can diameters are provided. No access to the cams nor roller assemblies is required to change can rotational velocities at the label pick-up stations which velocities must increase with increasing rim speed to avoid a wiping action between the cans and the labels and preserve the desirable rolling action at their interface. Since the parts can be fully enclosed now, they can be lubricated without any danger of lubricant contamination. For this purpose, there is a lubricant spray nozzle 27 seated in the bottom part 25 of the cam ring as shown in FIG. 3 and there is a lubricant runoff opening 28 spaced from it. The spray nozzle projects oil through the bores 29 in the rotary table to the bearings for the rotary disk shafts 20. There are pliable sealing rings 30, as shown in FIG. 2, for preventing leakage of the oil. Since the design permits flooding of the moving parts with lubricant, life and reliability of the apparatus is enhanced.

Now that the explanation has been given as to how the can supporting disks 7 change their rotational velocity as their driving rollers progress along the cams 23 and 24 has been explained, consideration will be given to how, in accordance with the invention, the proper rotational velocity for rolling on labels with cans of one of several different diameters is obtained. First of all, notice that the arm 31 which supports the label containing device 11 is clamped to fixed sleeve 19 by means of bolts 32. Thus, the labeling station is supported concentrically to the rotational axis of the wheel 6 and is fixed in height by means of a shoulder on sleeve 19. When it is desired to adjust the machine for handling cans of a different diameter, bolts 32 are loosened and arm 31 is swung until the label holder 11 is aligned with a particular section within the labeling region E. Then, as the rollers roll into the teeth of this section the disks will have the appropriate velocity for rolling on labels 2 for that particular can diameter. In order to relate the individual rotational velocities, an indicator 33 is fixed on holding arm 31 and it cooperates with calibration markings 34 on the circumference of the upwardly opened U-shaped cam ring support 25.

Thus, any time the labeling machine must be set up for a different can diameter it is only necessary to release clamping screws 32, swing the holding arm 31 in the proper direction to carry the label containing device 11 with it to the suitable section in the toothed cam and then tighten the clamping screws 32 again.

Of course, adjustments are necessary for the radial position of the label container 11 and in the glue application station 9 and in the brush-on station 13 for adaptation to the particular different label format. Instead of the aforementioned solution wherein there are six different regions in the toothed cam that produce a uniform speed of rotation of the can supporting disks, it is also possible to accomplish a continuous, uniform change of speed, from the first to the sixth velocity. In such case, within the six can diametrical ranges, all intermediary sizes will be exactly labeled, since, as already stated, the region in which the labels are picked up by the can where exact speed of rotation is desired is very short.

Although the rotational speed changer has been described in a particular type of labeling machine, it should be understood that it may be applied to other labeling machines as well.

I claim:

1. A machine adapted for applying labels to containers having various diameters, comprising:

a rotationally driven table, a label storage device supported radially away from the rotational axis of the table and means supporting said device for being adjusted along a circular path concentric to the axis of the table, a plurality of container support plates arranged around the rotational axis of said table and rotatable about axes parallel to the axis of the table for transporting containers to said label storage device for the containers to effect withdrawal of a label, cam follower means coupled to said plates, respectively, for being driven rotationally to thereby turn said plates and a container thereon, stationary cam means for being engaged by said follower means to cause rotation thereof as said table rotates, the configuration of said stationary cam means being such that rotational speed of said follower means changes as the follower means move along said cam means, such that by adjusting said label storage device along said circular path a selected container rotational speed can be obtained when the container is in contact with a label.

2. A machine adapted for applying labels to containers having various diameters, comprising:

a rotationally driven table, a label storage device and means supporting said device for being moved along a generally circular path concentric to the rotational axis of the table, a plurality of rotatable shafts arranged around the rotational axis of the table and a container support plate on each shaft for transporting containers past said label storage device for the container to withdraw a label from the device as the table rotates, first gear means coupled to the shafts, respectively, stationary gear means engageable by said first gear means as the table rotates, said stationary gear means having teeth of differing pitch for changing the rotational speed of the shafts and any container thereon as the table rotates such that by adjusting said label storage device along said circular path a selected container rotational speed can be obtained where the containers pass over the labels.

3. The labeling machine according to claim 2 wherein a plurality of consecutive teeth in said stationary gear means and adjacent pluralities of teeth have different pitches so the rotational speed of said shafts will change in steps.

4. The labeling machine according to any one of claims 2 or 3 wherein the pitch of the teeth on said stationary gear means increases in the direction of table rotation so that the rotational speed of the shafts decreases correspondingly.

5. The labeling machine according to any one of claims 2 or 3 wherein said stationary gear means is comprised of two similar toothed cams superimposed to each other and shifted rotationally by the distance of one pitch and lying in different planes, said first gear means comprising disk means fastened to each of said shafts and sets of rollers mounted on said disk means for rotating about axes parallel to and equally radially spaced from the axis of the shaft, one set of rollers being mounted to one side of said disk means for meshing with the teeth in one of the cams and the other set being mounted to the other side for meshing with the teeth on the other of said cams.

6. The labeling machine according to claims 2 or 3 further comprising:

a shaft supporting said table for rotation, stationary sleeve means through which said shaft extends, said means supporting the label storage device comprising arm means mounted to said sleeve means for swinging about said sleeve means to position said storage device along said circular path.

7. A machine adapted for applying labels to cylindrical containers having various diameters, comprising:

a rotationally driven table, a label storage device supported radially away from the rotational axis of the table and means supporting said device for having its position adjusted along a circular path concentric to the axis of the table, a plurality of shafts arranged concentrically to the rotational axis of the table and mounted for rotating on the table about axes parallel to the table axis, a container supporting plate mounted to each shaft for transporting containers to said storage device with glue on the containers for rolling on a label to withdraw the label from said storage device, a disk mounted to each shaft and rollers mounted to said disk for rotation about axes that are parallel to and radially spaced from the axes of the shaft, some of said rollers being mounted to one side of said disk and other of said rollers to the other side of the disk and all of the rollers being equiangularly spaced from each other, two cam members each having a row of teeth arranged at levels corresponding, respectively, to the levels of the rollers on one and the other side of said disks, such that as said table rotates said rollers on the successive disks will engage with said teeth to cause containers on the plates to rotate, the pitch of said teeth changing progressively so as to alter the rotational speed of the containers as the rollers advance along the rows of teeth such that by said adjusting of the position of said label storage device the container can be made to rotate at a speed commensurate with its diameter when the container contacts the label.

* * * * *